US006379208B2

(12) United States Patent
Khanamirian

(10) Patent No.: US 6,379,208 B2
(45) **Date of Patent: *Apr. 30, 2002**

(54) PERSONAL FLOTATION DEVICE WITH ADJUSTING FLOTATION LAYERS

(75) Inventor: Alexander Khanamirian, Miami Beach, FL (US)

(73) Assignee: Extrasport, Inc., Miami, FL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/515,230

(22) Filed: Feb. 29, 2000

(51) Int. Cl.[7] ..... B63C 9/08
(52) U.S. Cl. ..... 441/106; 441/117
(58) Field of Search ..... 441/106, 108, 441/114, 115, 116, 117, 118, 119

(56) References Cited

U.S. PATENT DOCUMENTS

| | | | | |
|---|---|---|---|---|
| 3,094,724 A | * | 6/1963 | Lerner | 441/118 |
| 3,261,042 A | | 7/1966 | Baker | |
| 3,366,984 A | * | 2/1968 | Le Blanc | 441/118 |
| 3,369,262 A | | 2/1968 | Judd | |
| 4,281,428 A | | 8/1981 | Rochlin | |
| 4,380,441 A | | 4/1983 | Harr et al. | |
| 4,551,107 A | | 11/1985 | Scheurer et al. | |
| 4,555,234 A | | 11/1985 | Kent | |
| 4,934,973 A | * | 6/1990 | Taylor | 441/118 |

OTHER PUBLICATIONS

August 1998 Extrasport, Inc. Flyer

* cited by examiner

*Primary Examiner*—Stephen Avila
(74) *Attorney, Agent, or Firm*—Foley & Lardner

(57) ABSTRACT

A personal flotation device having adjustable flotation layers is disclosed. The personal flotation device includes at least one back body portion, at least one front body portion opposite the back body portion, shoulder portions connecting the at least one back body portion and the at least one front body portion, and side portions connecting the at least one back body portion and the at least one front body portion. At least one of the front body portion and the back body portion includes a first flotation layer, a second flotation layer opposite the first flotation layer and a low friction interface layer extending in a plane between the first flotation layer and the second flotation layer. At least one of the first flotation layer and the second flotation layer is movable relative to the low friction in a second plane parallel to the first plane. In one exemplary embodiment, the first flotation layer has a first end and a second end while the second flotation layer has a third end coupled to the first end for movement with the first end and a fourth free end movable relative to the second end. In one exemplary embodiment, the device includes at least one first panel defining a first pocket and at least one second panel defining a second pocket within the first pocket. The first flotation layer is disposed within the first pocket between the second pocket and the at least one first panel while the flotation layer is disposed within the second pocket.

23 Claims, 2 Drawing Sheets

PERSONAL FLOTATION DEVICE WITH ADJUSTING FLOTATION LAYERS

FIELD OF THE INVENTION

The present invention relates to personal flotation devices such as life jackets and life vests. In particular, the present invention relates to a personal flotation device having multiple flotation layers that conform to the shape of a wearer's body.

BACKGROUND OF THE INVENTION

Personal flotation devices, commonly referred to as life jackets or life vests, are worn by individuals during boating or water sports to provide an individual with enhanced buoyancy. Such personal flotation devices or "PFDs" have evolved over the years from the old "Mae West" or kapok life vests to vinyl-covered foam rubber life jackets and to more specialized flotation devices for different types of water sports or boating activities. The U.S. Coast Guard has instituted regulations regarding the minimum flotation required by PFDs. As set forth in those regulations, the minimum flotation required depends upon the expected use of the PFD. The U.S. Coast Guard regulations, Title 33 of the Code of Federal Regulations ("CFR"), Chapter 1, Part 175, subpart B, require that recreation boats have at least one Coast Guard approved PFD on board for each person on a boat.

Due to recent heightened concerns regarding safety, Coast Guard regulations pertaining to PFDs have become stricter requiring increased minimum flotation or increased buoyancy. To provide the necessary buoyancy, many PFDs have been provided with thicker or additional buoyant material. Although the thicker or additional buoyant material provides increased buoyancy, it also increases the bulk of the PFD. This increased bulk limits the freedom of movement available to a wearer of the PFD. In many activities such as canoeing, kayaking, boating, windsurfing and the like, significant arm, shoulder and upper torso movement is required when the wearer is paddling or maneuvering sails and lines. During such movement, the PFD tends to ride up or shift on the wearer's torso, thereby making the PFD uncomfortable to wear and also interfering with the wearer's mobility. Moreover, even during other activities which do not require great mobility, the increased bulk now required in PFDs for increased buoyancy prevents the PFDs from comfortably conforming to different shapes and sizes of different individuals.

As a result, there is a continuing need for a PFD that provides increased buoyancy, that provides freedom of movement and that easily conforms to different body sizes and shapes of different individuals.

SUMMARY OF THE INVENTION

The present invention provides a personal flotation device including at least one back body portion, at least one front body portion opposite the at least one back body portion, shoulder portions connecting the at least one back body portion and the at least one front body portion, and side portions connecting the at least one back body portion and the at least one front body portion. At least one of the front body portion and the back body portion includes a first flotation layer, a second flotation layer opposite the first flotation layer, and a low friction layer extending in a plane between the first flotation layer and the second flotation layer. At least one of the first flotation layer and the second flotation layer is movable relative to the low friction layer in a second plane parallel to the first plane.

The present invention provides a personal flotation device including at least one buoyant back body portion, at least one buoyant front body portion opposite the at least one back body portion, shoulder portions connecting the at least one back body portion and the at least one front body portion, and side portions connecting the at least one back body portion and the at least one front body portion. At least one of the front body portion and the back body portion includes a first flotation layer extending in a first plane and having a first end and a second end and a second flotation layer extending in a second plane parallel to the first plane. The second flotation layer has a third end coupled to the first end for movement with the first end and a fourth free end movable relative to the second end of the first flotation layer.

The present invention provides a personal flotation device including at least one back body portion, at least one front body portion opposite the at least one back body portion, shoulder portions connecting the at least one back body portion and the at least one front body portion, and side portions connecting the at least one back body portion and the at least one front body portion. At least one of the front body portion and the back body portion includes at least one first panel defining a first pocket, at least one second panel defining a second pocket within the first pocket, a first flotation layer disposed within the first pocket between the second pocket and the at least one first panel, and a second flotation layer disposed within the second pocket.

DETAILED DESCRIPTION OF THE PREFERRED EMBODIMENTS

Figure 1:
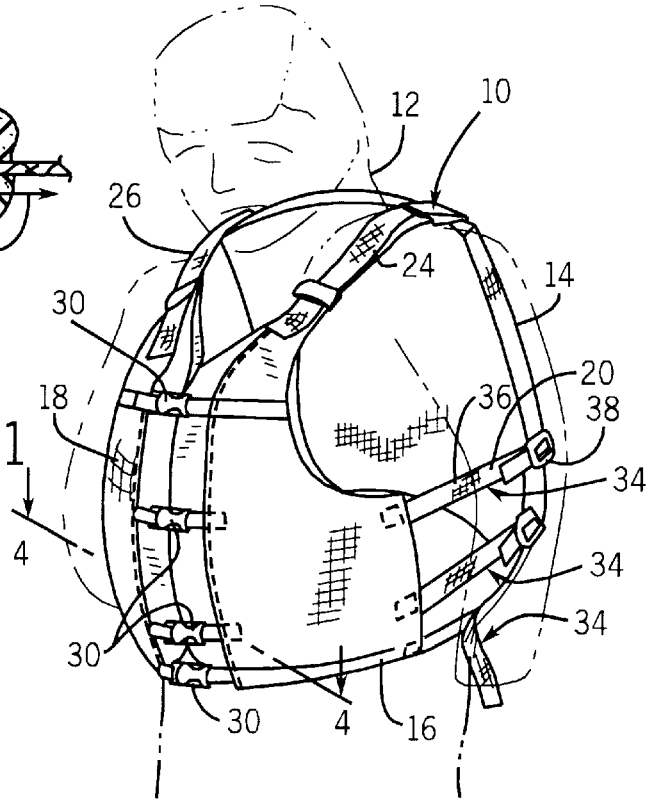
FIG. 1 is a front perspective view of an exemplary personal flotation device of the present invention being worn by an individual.

FIG. 1 is a front perspective view of an exemplary personal flotation device 10 being worn by user 12. The personal flotation device 10 provides user 12 with increased buoyancy and generally includes back body portion 14, left side front body portion 16, right side front body portion 18, left side portion 20, right side portion 22 (shown in FIG. 3), left shoulder portion 24, and right shoulder portion 26. Back body portion 14 comprises a large section or panel of buoyant flotation material configured to extend adjacent the back of user 12. The flotation material is preferably buoyant, flexible and relatively thin. In the exemplary embodiment, back body portion 14 includes a layer of closed cell foam plastic such as closed cell polyvinylchloride foam. Such foam material is commonly sold under the trademark AIREX. Alternatively, various other buoyant flotation materials may also be used to form back body portion 14.

Back body portion 14 additionally includes a durable fabric covering the layer of flotation material to provide strength, comfort and water drainage. In the exemplary embodiment, the fabric covering comprises a nylon material, such as a 200 denier nylon oxford fabric. Alternatively, various other fabric coverings may also be used. Although back body portion 14 is illustrated as generally including a single layer of flotation material, back body portion 14 may alternatively include additional layers of flotation material. Moreover, although less desirable, the fabric covering may be omitted depending upon the durability of the flotation material.

Left front body portion 16 and right front body portion 18 are substantially identical to one another and cooperate with back body portion 14 to provide user 12 with enhanced buoyancy. Left front body portion 16 and right front body 18 generally comprise elongate flexible sections or panels of flotation material configured to extend adjacent to the front of the torso of user 12. Left front body portion 16 and right front body portion 18 are releasably connectable to one another by fasteners 30 preferably comprising side release buckles. Various other fasteners may also be used to releasably connect body portion 16 to body portion 18.

Left front body portion 16 is additionally coupled to back body portion 14 by left side portion 20 and left shoulder portion 24. Right front body portion 18 is additionally coupled to back body portion 14 by the right side portion 22 and right shoulder portion 26. As a result, right body portion 14, left front body portion 16, right front body portion 18, left side portion 20, right side portion 22 and shoulder sections 24, 26 form a buoyant vest configured to be worn about the torso of user 12. As will be described in greater detail hereafter, front body portions 16, 18 each include multiple layers of flotation material which move relative to one another. As a result, personal flotation device 10 provides user 12 with increased freedom of movement and greater comfort.

Left side portion 20 and right side portion 22 extend between right body portion 14 and front body portions 16, 18 on opposite sides of user 12. Left side portion 20 is substantially identical to right side portion 22 and generally includes multiple adjustment strap assemblies 34. Each adjustment strap assembly 34 generally includes a strap 36 and a fastener 38. Strap 36 is coupled, preferably by stitching to one of front body portion 16, 18 and is adjustably connected to back body portion 14 by means of fastener 38 which preferably comprises a slide buckle. Strap adjustment assembly 34 enables personal flotation device 10 to be adjusted to accommodate users having differently sized torsos. As will be appreciated, left side portion 20 as well as right side portion (not shown) may alternatively comprise various other mechanisms for adjustably connecting back body portion 14 to front body portion 16, 18. For example, in lieu of using strap assemblies 34, left side portion 20 and the right side portion (not shown) may alternatively include elastic fabric extending between back body portion 14 and front body portions 16, 18, whereby the elastic fabric stretches to accommodate users having differently sized torsos. In such an alternative embodiment, strap assembly 34 may be additionally provided to enhance adjustability. Although less desirable, left side portion 20 and right side portion 22 may alternatively comprise panels of buoyant flotation material or panels of inelastic fabric fixed to and between back body portion 14 and front body portions 16, 18 or may be integrally formed as part of a single unitary body with both back body portion 14 and front body portions 16, 18.

Shoulder portions 24 and 26 extend between back body portion 14 and front body portions 16, 18 across the left and right shoulders of user 12, respectively. Shoulder portions 24, 26 preferably comprise adjustable strap assemblies. Alternatively, shoulder portions 24, 26 comprise non-adjustable strap assemblies or may comprise panels of buoyant flotation material extending between back body portion 14 and front body portions 16, 18 or may be integrally formed as part of a single unitary body with back body portion 14 and/or front body portions 16, 18.

Figure 3:
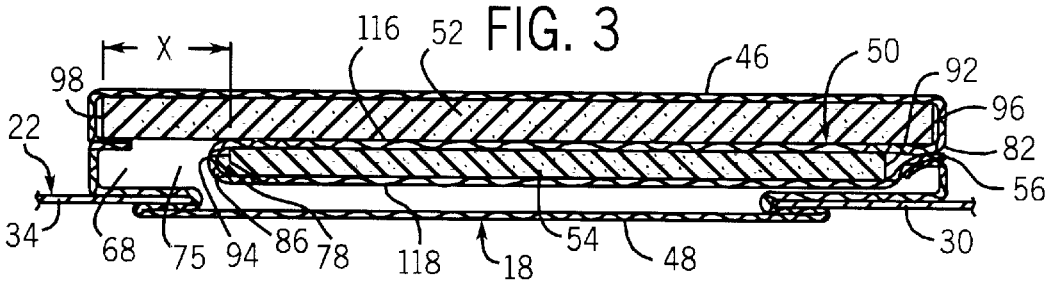
FIG. 3 is a sectional view of the personal flotation device of FIG. 1 prior to adjustment.
Figure 2:
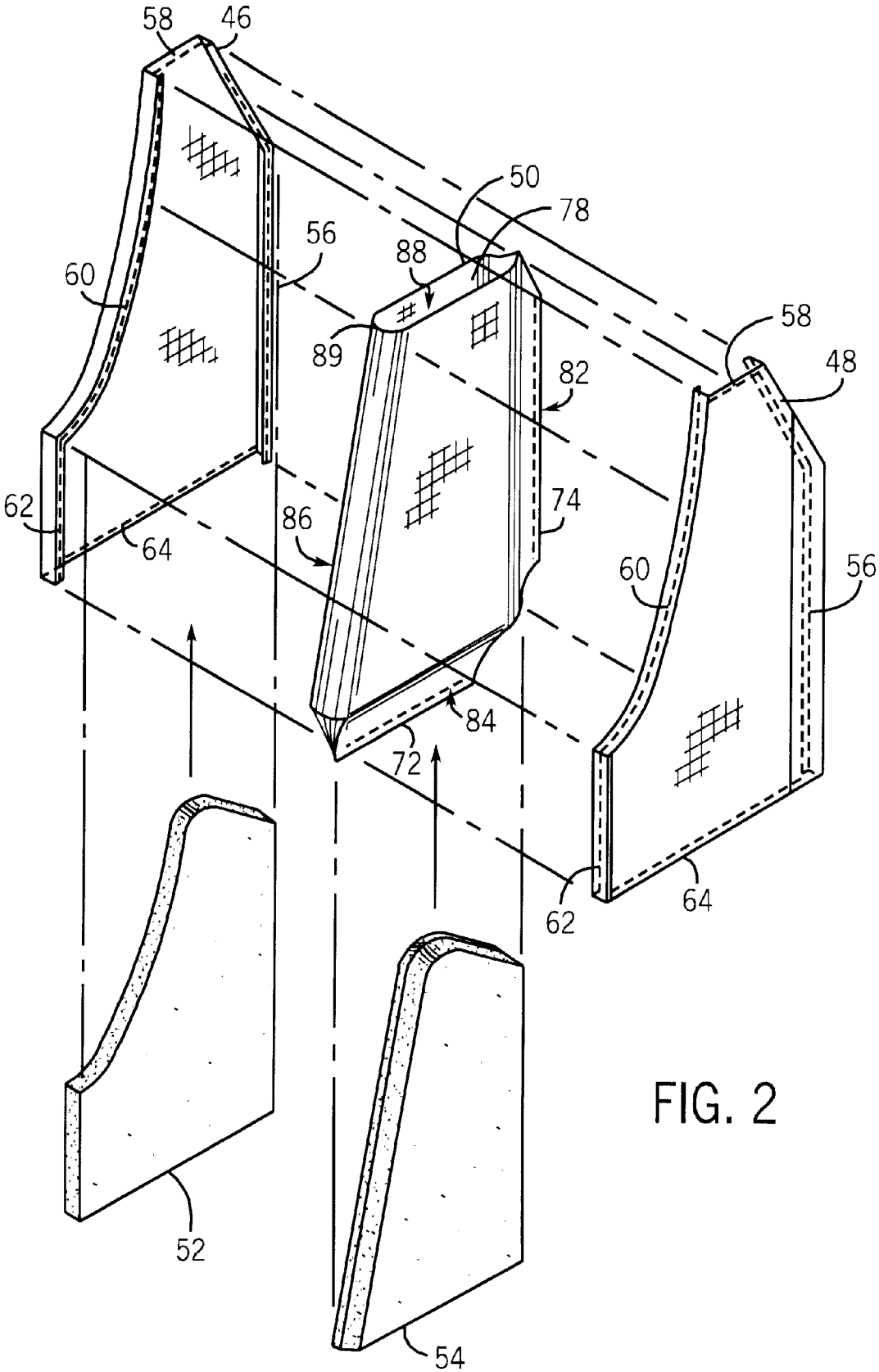
FIG. 2 is an exploded perspective view of a front body portion of the personal flotation device of FIG. 1.

FIGS. 2 and 3 illustrate left front body portion 16 in greater detail. As best shown by FIG. 2, front body portion 16 generally includes panel 46, panel 48, panel 50, flotation layer 52, and flotation layer 54. Panels 46 and 48 comprise distinct sheets of flexible material extending opposite to one another and affixed to one another along edges 56, 58, 60, 62 and 64 to form pocket 68 (shown in FIG. 3). Pocket 68 is sized to receive panel 50 as well as flotation layers 52, 54.

Panel 50 comprises an elongate sheet of flexible material folded and joined to itself along edges 72 and 74 to form pocket 78. Although pocket 78 is illustrated as being provided by a single panel 50 joined to itself, pocket 78 may alternatively be provided by multiple distinct sheets or panels joined to one another. Likewise, in lieu of being formed by two opposing panels joined to one another, pocket 68 may be formed from a single panel folded and joined to itself or may be formed by greater than two distinct panels joined to one another. In the exemplary embodiment, panels 46, 48 and 50 are joined preferably by stitching. As will be appreciated, panels 46, 48 and 50 may be joined by various other methods including adhesive bonding, thermal welding and the like. Moreover, panels 46, 48 and 50 may be joined by embossing or compressing adjacent ends together with flotation layer 52 or flotation layer 54 captured between such as shown and described in co-pending U.S. patent application Ser. No. 08/880,867, filed on Jun. 23, 1997 and entitled FABRIC LAMINATED FLOTATION FOAM MATERIAL FOR MANUFACTURING LIFE JACKETS AND SIMILAR ARTICLES AND ARTICLES MANUFACTURED USING SUCH MATERIALS (the full disclosure of which is hereby incorporated by reference).

As best shown by FIG. 3, panel 50 and its pocket 78 are disposed between panels 46 and 48 within pocket 68. Panel 50 has attached ends 82 and 84 (shown in FIG. 2) coupled to edges 56 and 64 (shown in FIG. 2) of panels 46, 48, respectively. Panel 50 further includes free ends 86 and 88 that are unattached within pocket 68. As a result, end 82 moves with edges 56 of panels 46, 48 while ends 86, 88 and corner 89 therebetween are free to move relative to edges 60 and 62. Although ends 82 and 84 are illustrated as being attached to and between panels 46 and 48, ends 86 or 88 may alternatively be attached to panels 46 and 48 in lieu of ends 82 and 84 being attached to panels 46 and 48. Furthermore, in lieu of both ends 82 and 84 being attached to panels 46 and 48, only one of ends 82 and 84 or one of ends 86 or 88 may alternatively be attached to either or both of panels 46 and 48.

Flotation layer 52 comprises a flat layer of buoyant material sized and shaped to fit within pocket 68 adjacent to panel 46 between panel 46 and panel 50. Flotation layer 54 comprises a layer of buoyant material sized and shaped to fit within pocket 78 of panel 50 such that a gap 75 is created. As shown by FIG. 3, flotation layer 54 has a first end 92 proximate to end 82 of panel 50 and a second opposite end 94 proximate to free end 86 of panel 50. Likewise, flotation layer 52 has a first end 96 proximate to end 82 of panel 50 and a second opposite end 98 proximate to free end 86 of panel 50. Because end 82 is affixed to panels 46 and 48 along edge 56, end 92 of flotation layer 54 is effectively coupled to end 96 of flotation layer 52. However, end 94 is free to move relative to end 98 of flotation layer 52. As a result, end 94 of flotation layer 54 as well as end 86 of panel 50 move or slide relative to end 98 of flotation layer 52 to conform to different sized and shaped torsos of user 12 and to provide user 12 with increased freedom of movement.

Figure 5:
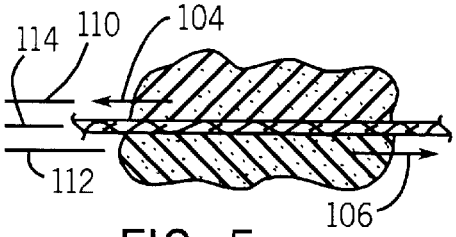
FIG. 5 is a greatly enlarged view of FIG. 4 taken along lines 5—5.
Figure 4:
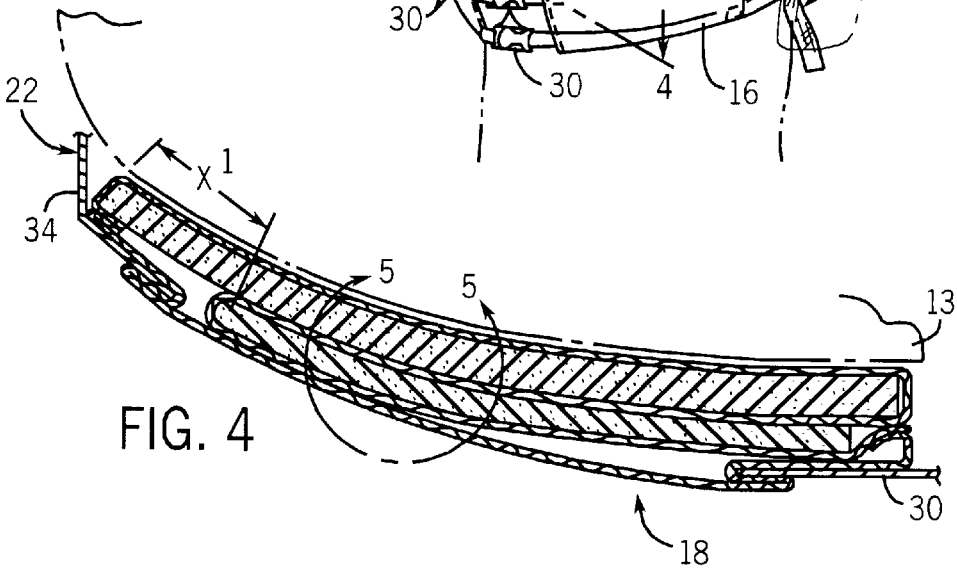
FIG. 4 is a sectional view of the personal flotation device of FIG. 1 taken along lines 4—4 after adjustment.

FIGS. 3–5 best illustrate the ability of front body portion 18 to adjust and conform to movement and shape of torso 13 of user 12. FIG. 3 depicts body portion 18 in an unadjusted state. FIG. 4 illustrates body portion 18 adjusting to accommodate either the shape of torso 13 of user 12 or movement of user 12. As shown in FIG. 3, prior to adjustment, end 94 of flotation layer 52 is spaced from end 98 of flotation layer 52 by distance X. However, after adjustment, end 94 of flotation layer 52 is spaced from end 98 of flotation layer 52 by distance X'. As shown by FIG. 5, this change is a result of flotation layer 52 and flotation layer 54 moving sideways relative to one another in the directions indicated by arrows 104 and 106. In particular, flotation layer 52 generally extends in a first plane 110, flotation layer 54 generally extends in a second plane 112 and panel 50 extending between layers 52 and 54 extends in a third plane 114. During adjustment, layers 52 and 54 move along planes 110 and 112, respectively, parallel to plane 114. As shown by FIG. 4, layers 52, 54 and panel 50 extend in generally arcuate planes 110, 112 and 114, respectively, conforming to the shape or movement of torso 13 of user 12. As shown by FIG. 4, the relative movement of flotation layers 52 and 54 and the change in distance from X to X' varies and depends upon the arcuate deformation of front body portion 18 that is needed to accommodate torso 13 of user 12.

In addition to forming pocket 78, panel 50 also provides a low friction interface between flotation layers 52 and 54. In particular, panel 50 is preferably formed from a material having a coefficient of friction less than a coefficient of friction of either layers 52 and 54. As a result, portion 116 of panel 50 extending between layers 52 and 54 further facilitates the relative movement of layers 52 and 54. Portion 118 of panel 50, extending between layer 54 and panel 48 also has a relatively low coefficient of friction so as to facilitate the relative movement of flotation layer 54 and panel 48. In the exemplary embodiment, flotation layers 52 and 54 are each formed from closed cell foam plastic such as closed cell polyvinylchloride foam. Such foam material is commonly sold under the trademark AIREX. Alternatively, various other buoyant flotation materials such as ethyl vinyl acetate foam which is also soft and somewhat pliable may be used. Flotation layers 52 and 54 each preferably have a thickness of approximately 0.875 inches. Panels 46, 48 and 50 are each formed from a flexible and durable fabric material such as 200 denier nylon oxford fabric to provide strength, comfort and water drainage.

Overall, front body portion 16 and front body portion 18, which are substantially identical in construction, enable personal flotation device 10 to provide user 12 with increased comfort and freedom of movement. Because flotation layers 52 and 54 are free to move relative to one another in parallel planes, layers 52 and 54 naturally reposition themselves relative to one another to accommodate arcuate deformation of front body portions 16 and 18 during movement of torso 13 or when personal flotation device 10 is initially positioned upon user 12. Because end 92 of flotation layer 54 is coupled relative to end 96 of flotation layer 52 while end 94 is relatively free with respect to end 98 of flotation layer 52, adjusting movement of layers 52 and 54 relative to one another is controlled to prevent shifting of layers 52 and 54 relative to one another in undesirable directions. Moreover, because front body portions 16, 18 include a low friction interface between layers 52 and 54, the relative movement of layers 52 and 54 is further facilitated. As a result, personal flotation device 10 provides user 12 with a greater buoyancy while still also providing freedom of movement and comfort.

FIGS. 1–5 illustrate but one exemplary embodiment of personal flotation device 10. Various other alternatives are also contemplated. For example, although personal flotation device 10 is illustrated as including two separate front body portions 16, 18, personal flotation device 10 may alternatively comprise a single one-piece front body portion configured to encompass the entire front of torso 13. An example of such a single one-piece front body portion is shown and described in co-pending U.S. patent application Ser. No. 09/637,972, entitled PERSONAL FLOTATION DEVICE WITH FRONT PORTION CENTRAL PULL SYSTEM, by Alexander Khanamirian, filed on the same date herewith (the full disclosure of which is hereby incorporated by reference). Although body portions 16 and 18 are illustrated as including two side-by-side flotation layers 52 and 54 that are movable relative to one another, front body portions 16, 18 may alternatively include three or more similarly arranged flotation layers. Although personal flotation device 10 is illustrated as only providing front body portions 16, 18 with multiple flotation layers that move relative to one another, back body portion 14 may also include such multiple flotation layers.

Although flotation layer 54 is illustrated as being disposed within pocket 78 provided by panel 50, flotation layer 54 may alternatively be fixed to portion 116 of panel 50 by stitching, adhesives, bonding, fusion, or other joining or coupling means. In such an alternative embodiment where flotation layer 54 is affixed to portion 116 of panel 50 and whereby portion 116 is secured to panels 46 and 48 adjacent to end 96 of flotation layer 52, portion 118 of panel 50 may be omitted since pocket 78 is no longer required to couple panel 50 to layer 54. Moreover, either or both of portions 116, 118 providing a low friction interface may be eliminated and replaced with a coating of low friction material applied to the surfaces of either or both of flotation layers 52, 54. Low friction material may also be molded with or otherwise formed as part of flotation layers 52, 54.

Although layer 52 is illustrated as being disposed within pocket 68 and affixed to panel 46, flotation layer 52 may alternatively be affixed to layer 46 by bonding or other joining methods. Although layer 52 is illustrated as directly contacting low friction interface portion 116 of panel 50, front body portion 18 may additionally include a layer of low friction material between portion 116 of panel 50 and layer 52. Such an additional layer may either at least partially encapsulate layer 52, may be permanently affixed to layer 52 by adhesives, fusion or other joining methods or may be coated upon layer 52. Although less desirable, front body portion 18 may alternatively omit interface portion 116 between flotation layers 52 and 54. Moreover, although less desirable, end 92 may also be permitted to move freely relative to end 96 of flotation layer 52.

Although the present invention has been described with reference to preferred embodiments, workers skilled in the art will recognize that changes may be made in form and detail without departing from the spirit and scope of the invention. Because the technology of the present invention is relatively complex, not all changes in the technology are foreseeable. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A personal flotation device comprising:

at least one back body portion;

at least one front body portion opposite the at least one back body portion;

shoulder portions connecting the at least one back body portion and the at least one front body portion; and side portions connecting the at least one back body portion and the at least one front body portion, wherein at least one of the front body portion and the back body portion includes:

a first flotation layer;

a second flotation layer opposite the first flotation layer; and a low friction interface layer extending in a plane between the first flotation layer and the second flotation layer, wherein the low friction interface layer includes a material different than that of the first flotation layer, wherein at least one of the first flotation layer and the second flotation layer is movable relative to the low friction layer in a second plane parallel to the first plane.

2. The device of claim 1, wherein the low friction layer comprises nylon.

3. The device of claim 1, including:

at least one first panel defining a first pocket; and at least one second panel defining a second pocket within the first pocket, wherein the first flotation layer is disposed within the first pocket between the second pocket and the at least one first panel and wherein the second flotation layer is disposed within the second pocket.

4. The device of claim 3, wherein the second flotation layer is smaller than the first pocket.

5. The device of claim 3, wherein the at least one second panel has a first end attached to the at least one first panel and a second free unattached end.

6. The device of claim 1, wherein the low friction interface layer is coupled to the second flotation layer so as to move with the second flotation layer.

7. The device of claim 6, including at least one panel forming a pocket receiving the second flotation layer, wherein the low friction interface layer extends along an outer surface of the at least one panel.

8. The device of claim 7, wherein the low friction interface layer is integrally formed as part of the at least one panel.

9. The device of claim 1, wherein the first flotation layer extends between the second flotation layer and a user's body and wherein the second flotation layer moves relative to the first flotation layer.

10. The device of claim 1, wherein the first and second planes are arcuate when the device is being worn.

11. The device of claim 1, wherein the first flotation layer and the second flotation layer include flotation foam.

12. The device of claim 1, wherein the material of the low friction interface layer is different than that of the second flotation layer.

13. A personal flotation device comprising:

at least one back body portion;

at least one front body portion opposite the at least one back body portion;

shoulder portions connecting the at least one back body portion and the at least one front body portion; and side portions connecting the at least one back body portion and the at least one front body portion, wherein at least one of the front body portion and the back body portion includes:

a first flotation layer extending in a first plane and having a first end and a second end;

a second flotation layer extending in a second plane parallel to the first plane, the second flotation layer having a third end coupled to the first end for movement with the first end and a fourth free end movable relative to the second end of the first flotation layer;

at least one first panel defining a first pocket; and at least one second panel defining a second pocket within the first pocket, wherein the first flotation layer is disposed within the first pocket between the second pocket and the at least one first panel and wherein the second flotation layer is disposed within the second pocket.

14. The device of claim 13, wherein the at least one second panel has a first end attached to the at least one first panel and a second free unattached end.

15. The device of claim 13 including a low friction layer between the first flotation layer and the second flotation layer.

16. The device of claim 15, wherein the low friction layer extends in a first plane and wherein at least one of the first flotation layer and the second flotation layer is movable relative to the low friction layer in a second plane parallel to the first plane.

17. The device of claim 16, wherein the first and second planes are arcuate when the device is being worn.

18. The device of claim 15, wherein the low friction layer has a first coefficient of friction and wherein the second flotation layer and wherein the first flotation layer and the second flotation layer has at least one second coefficient of friction greater than the first coefficient of friction.

19. The device of claim 13, wherein the first flotation layer and the second flotation layer include flotation foam.

20. The device of claim 13, wherein the first flotation layer and the second flotation layer each have a thickness of about 0.875 inches.

21. A personal flotation device comprising:

at least one back body portion;

at least one front body portion opposite the at least one back body portion;

shoulder portions connecting the at least one back body portion and the at least one front body portion; and side portions connecting the at least one back body portion and the at least one front body portion, wherein at least one of the front body portion and the back body portion includes:

at least one panel defining a first pocket;

at least one second panel defining a second pocket within the first pocket;

a first flotation layer disposed within the first pocket between the second pocket and the at least one first panel; and a second flotation layer disposed within the second pocket.

22. The device of claim 21, wherein the at least one second panel has a first end attached to the at least one first panel and a second free unattached end.

23. The device of claim 21, including a low friction layer between the at least one second panel and the first flotation layer.

* * * * *